US006068196A

United States Patent [19]

Benenowski et al.

[11] Patent Number: 6,068,196

[45] **Date of Patent: *May 30, 2000**

[54] EXPANSION JOINT FOR PART OF A RAILWAY TRACK

[75] Inventors: Sebastian Benenowski; Hubertus Höhne, both of Butzbach; Alfred Kais, Lich-Eberstadt; Erich Nuding, Aalen, all of Germany

[73] Assignee: BWG Butzbacher Weichenbau, GmbH, Butzbach, Germany

[ * ] Notice: Under 35 U.S.C. 154(b), the term of this patent shall be extended for 670 days.

[21] Appl. No.: 08/751,068

[22] Filed: Nov. 15, 1996

Related U.S. Application Data

[62] Division of application No. 08/325,304, filed as application No. PCT/EP93/01117, May 7, 1993, Pat. No. 5,590,883.

[30] Foreign Application Priority Data

| | | | |
|---|---|---|---|
| May 8, 1992 | [DE] | Germany | 42 14 756 |
| May 8, 1992 | [DE] | Germany | 42 14 605 |
| Sep. 1, 1992 | [DE] | Germany | 92 11 520 U |

[51] Int. Cl.[7] ..... E01B 11/42

[52] U.S. Cl. ..... 238/171

[58] Field of Search ..... 238/171, 151, 238/172, 173, 174, 187; 104/123, 124

[56] References Cited

U.S. PATENT DOCUMENTS

| | | | |
|---|---|---|---|
| 411,362 | 9/1889 | Weir | 238/171 |
| 2,067,589 | 1/1937 | Clarke | 238/171 |
| 4,171,774 | 10/1979 | Deslauriers | 238/171 |
| 4,785,994 | 11/1988 | Crone et al. | 238/171 |

FOREIGN PATENT DOCUMENTS

| | | | |
|---|---|---|---|
| 48463 | 1/1911 | Austria | 238/171 |
| 1298311 | 11/1962 | France | 238/171 |
| 2185192 | 12/1973 | France | 238/171 |
| 2307407 | 8/1974 | Germany . | |
| 3016492 | 1/1982 | Germany . | |
| 4014248 | 11/1991 | Germany . | |
| 4014249 | 11/1991 | Germany . | |
| 9410383 | 5/1994 | WIPO | 238/171 |

*Primary Examiner*—S. Joseph Morano
*Attorney, Agent, or Firm*—Dennison, Scheiner, Schultz & Wakeman

[57] ABSTRACT

An expansion joint for part of a railway track arranged on a foundation has a stock rail with a stock rail head and a tongue movable with respect to and along said stock rail head, upon which at least one fastening device acys for pressing it on the stock rail. This expansion joint enables the rail foot to be lingitudinally moved with little friction and excludes tipping of the stock rail or tongue. For that purpose, the tongue is not bolted, but pressed only against the stock rail by the fastening device, and the force thus transmitted is decomposed into components that act, on the other hand, in the direction of the foundation and, on the other hand, in the direction of the stock rail head. The force is transmitted by a rolling element extending from a shaft which is anchored to the foundation.

20 Claims, 20 Drawing Sheets

EXPANSION JOINT FOR PART OF A RAILWAY TRACK

This is a division of application Ser. No. 08/325,304, filed Nov. 8, 1994, now U.S. Pat. No. 5,590,833, which is a 371 of PCT/EP93/01117, filed May 7, 1993.

BACKGROUND OF THE INVENTION

The invention relates to an expansion joint for part of a railway track disposed on a foundation which has a stock rail with a stock rail head, web and foot and a tongue movable with respect to and along said stock rail, upon which tongue at least one fastening means acts to press it onto the head of the stock rail.

In known expansion joints, also designated as expansion devices and permitting a movement between the structure and the rail in the vicinity of bridges, for example, a positive connection is made to permit movement of the tongue relative to the stock rail. To this end, a tongue of solid rail profile can be fixed between the stock rail and a clamping jaw disposed stationarily on the opposite side. The foot of the tongue and that of the stock rail are disposed on a common foundation at the same level. As a result, the stock rail is supported substantially on the foundation only by the stock rail half facing away from the tongue. Instabilities are compensated for by the stock rail being attached with supports and angle pieces. This entails additional maintenance work.

A conventional rail joint is described in DE 30 16 492 A1, for example. There is a slight clearance between the clamping jaws and the facing web surface of the tongue, permitting the requisite movability of the tongue in relation to the stock rail. This can led to tipping of the tongue or the rail.

OBJECTS OF THE INVENTION

The object underlying the present invention is to develop an expansion joint of the type described at the outset such that on the one hand a problem-free relative movement between the stock rail and the tongue in the longitudinal direction of the latter is possible and on the other hand it is ensured that neither the stock rail nor the tongue can tip, and that the tongue firmly presses against the stock rail head.

The problem is solved in accordance with the invention on the one hand in that the tongue presses against the stock rail in a non-positive connection via the fastening means. In particular, the fastening means acts in the transitional area of the tongue foot and tongue web such that a force component division takes place in the direction both of the foundation and of the stock rail head.

In particular, it is provided that the fastening means is a clamp extending from the foundation or from an element disposed thereon and being supported in the transitional area of tongue foot and web in order to transmit force components in the direction both of the foundation and of the stock rail head.

Alternatively, it is provided that the fastening means extends from the foundation or from an element such as a sliding or support block disposed thereon, and is supported by a rolling or sliding element in the transitional area of tongue foot and web in order to transmit force components in the direction both of the foundation and of the stock rail head.

In accordance with the invention applicants have discovered that, a positive or bolted connection is no longer necessary to fix the tongue, which has a pointed tongue profile known from railway switches; a non-positive or pressure only connection is substantially sufficient if, aligned such that the forces to be transmitted for fixing the rail are split up such that on the one hand tip-free support on the foundation and on the other hand firm pressure against the stock rail head are assured.

Using the measures in accordance with the invention, it is possible for the stock rail underside and the tongue foot underside to be at different levels, with the rail foot extending underneath the tongue foot, i.e. with the stock rail being supported over the full width of the rail foot.

To hold down the stock rail, a conventional clamp can be used on one side, and on the opposite side the tongue, indirectly or directly, a support block, a slide chair or a spring element extending therefrom can be used.

In particular, it is provided that the tongue is disposed on a slide chair in a longitudinally movable manner, from which slide chair extends a spring element resting on the stock rail foot.

Preferably, the tongue can be supported in sliding manner on a support surrounding the stock rail foot in some areas both on the foundation side and on the tongue side. The support itself here preferably consists of a plastic material of suitable stiffness.

The support can be laterally limited by a block against which the longitudinal tongue foot edge facing away from the stock rail presses. The fastening means then extends from the block itself and acts in non-positive manner on the tongue.

The block can be disposed movable in relation to the foundation. In this case, anchoring means such as bolts pass through the block and fix the fastening means themselves.

In a further development of the invention, it is provided that the tongue is supported on a support block that in turn rests on the stock rail foot and presses against a stop on the side facing away from the stock rail, and that the support block disposed movably in relation to the foundation is passed through by an anchoring means such as a bolt connecting the fastening means to the foundation or to a support. This anchoring means itself can be supported in relation to the fastening means by spring elements such as cup springs. The result is a movability such that rail tolerances in particular can be compensated for.

To ensure that during the longitudinal movement of the tongue the latter always retains the necessary spacing i.e. the sleeper interval, particularly when longitudinal movability is over more than one sleeper interval, it is provided that the tongue be supported on support blocks in the transitional area in which the tongue foot underside is higher than that in the tongue root area, said blocks on the one hand following in some sections the longitudinal movement of the tongue and on the other hand being holdable in the area of foundations. This measure ensures at all times that the tongue is supported at the requisite distances, while at the same time ensuring that there is no hindrance to the longitudinal movement of the tongue by the support blocks or by similarly acting elements due to the pertaining level difference.

In particular, the support blocks are movably disposed on a sliding plate that has catches for support blocks in the area preferably of foundations, said catches being formable by geometrical changes to the sliding plate.

To permit the support blocks to retain their spacing automatically, it is further provided that they are spring-loaded in relation to one another.

The necessary support for the tongue can of course also be achieved by other suitable measures, such as hydraulically adjustable foundation sections of which the adjustment is triggered by the longitudinal movement of the tongue itself.

On the other hand, the object is achieved in accordance with the invention by an expansion joint for a railway track disposed on a foundation with a stock rail with stock rail head, web and foot and a tongue movable relative to and along said stock rail, in that the stock rail is disposed in its longitudinal direction movable in relation to the tongue in order to form the expansion joint.

SUMMARY OF THE INVENTION

In accordance with a particularly noteworthy proposal, it is provided that the stock rail presses during its longitudinal movement against the tongue in an area with a shape corresponding to the bending line of the stock rail. Unlike the prior art, the area in which the stock rail is pressing against the tongue has a curvature that corresponds not to a circle segment, but to the bending line of the stock rail. As a result, only low transverse forces are needed to bend the stock rail during its longitudinal movement. Firm pressure of the stock rail against the tongue is assured in every position. This results in reduced wear and smooth running for the rolling stock crossing the expansion joint.

To ensure that the stock rail is movable in relation to the tongue, while at the same time ensuring that the tongue can also be moved longitudinally to the extent necessary to cope with temperature-related length changes, a further proposal of the invention provides for a friction coefficient of $\mu_B \leqq 0.1$ between contacting surfaces of the stock rail underside and the associated support/sliding surface, and for a friction coefficient $\mu_z \geqq 0.3$ between contacting surfaces of the tongue foot underside and associated support surface.

To ensure the differing friction coefficients, an intermediate layer can be disposed between the stock rail/tongue foot underside and the foundation/support block and can if necessary be designed continuous and have differing sections in order to obtain the required friction coefficients. This intermediate layer can extend in relation to the tongue into the area in which the fastening means is supported on the foot side. The same applies with regard to the stock rail foot, i.e. the intermediate layer extends up to the transitional area of foot and web in which the fastening means is supported.

In accordance with a further development, it is provided that in particular when longitudinal movability is over more than one sleeper interval, the stock rail rests on support blocks that on the one hand follow in some sections the longitudinal movement of the stock rail and on the other hand are holdable in the area of foundations. These measures ensure at all times that the stock rail is supported with the required distances.

In particular, the support blocks are disposed movably on a sliding plate that has in the area of foundations preferably catches for support blocks, said catches being formable by geometrical changes to the sliding plate.

To permit automatic spacing of the support blocks in relation to one another, it is further provided that these blocks are spring-loaded against one another.

The fastening means for the stock rail itself is preferably a rolling or sliding element preferably spring-loaded and extending directly or indirectly from the foundation. This ensures secure contact and hence the necessary transmission of force in the transitional area of stock rail foot and web, while at the same time permitting compensation for rail tolerances.

The tongue itself can be fixed on the side facing away from the stock rail by standard clamps or clamping plates. The tongue can also rest on a support block that extends in sections over the tongue-side stock rail foot in order to secure the stock rail.

Supplementary thereto or as a development that is inventive per se, it is provided that a fastening means acts on the stock rail and effects a non-positive connection between the stock rail head and the tongue. Here the fastening means is supported in the transitional area of stock rail foot and web in order to transmit the force components in the directions both of the foundation and of the stock rail head.

Finally, an overriding and independently protected idea of the invention provides for a further development of an expansion joint that leads to a minimal track change, this having the advantage that the length of the expansion joint, i.e. of the expansion device, can be reduced in comparison with known expansion joints. The design allows the use both of expansion joints to the prior art and those designed in accordance with the invention.

To achieve this aim, it is proposed that the shape of the stock rail has a curvature in the area in which the tongue is pressing against it, said curvature following the bending line of the tongue in that area in which the tongue presses against the stock rail.

Unlike in the prior art, the curvature of the stock rail does not follow a circle, as a result of which the tongue—interacting with the stock rail and fixed at a distance from the stock rail to allow exclusive movement in its longitudinal direction—would otherwise undergo the effects of forces that would cause in the tongue tip area a divergence from the stock rail that would be all the more pronounced the further the tongue is moved in, i.e. has moved along the stock rail.

With this design in accordance with the invention, only low forces are needed to bend the tongue. Firm pressure of the tongue against the stock rail is ensured in every position. Wear is also reduced and quiet running is achieved for rolling stock crossing the expansion joint.

Further details, advantages and features of the invention are clear not only from the claims and from the features they describe, singly and/or in combination, but also from the following description of a preferred embodiment shown in the drawing.

DETAILED DESCRIPTION OF THE INVENTION

Figure 1:
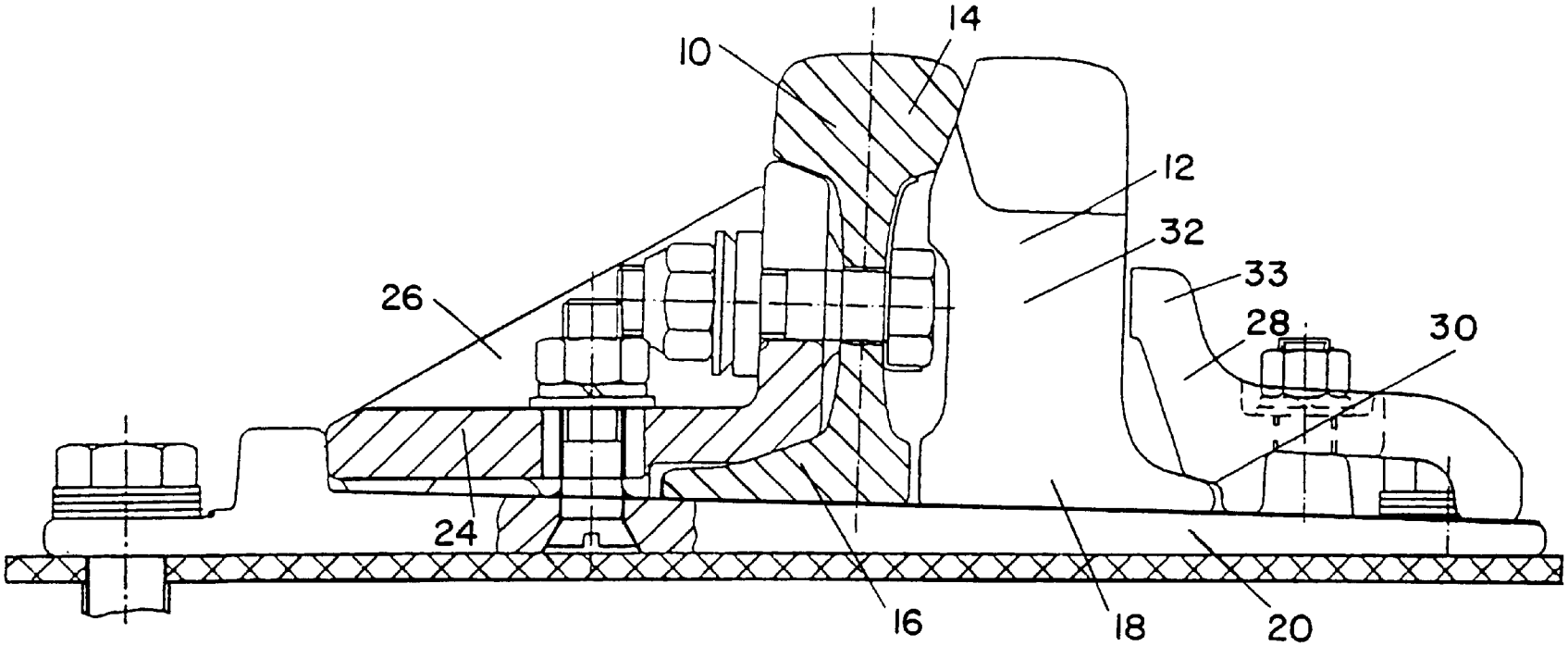
FIG. 1 PRIOR ART
FIG. 1 shows a sectional view of an expansion joint according to the prior art with a tongue comprising a solid rail profile.

FIG. 1 is a section through an expansion joint according to the prior art. A stock rail (10) is assigned a tongue (12) of a solid rail profile that rests in some sections on the rail head (14). The undersides of both the stock rail foot (16) and the tongue foot (18) are on the same level and are disposed on a foundation (20). As a result, the stock rail (10) rests virtually on one half of the rail foot (16). To prevent it from tipping, supporting angles (24) connected to the foundation (20) are provided as well as clamps that surround supporting legs (26).

The tongue (12) is fixed in positive manner between the stock rail (10) and a clamping jaw (28) which is also connected to the foundation (20) by fastening means not shown in detail. The clamping jaw (28) has on the foundation side a longitudinal recess (30) in which an edge portion of the tongue foot (18) extends. In addition, a section (33) assigned to the web (32) of the tongue is provided, which is however at a slight distance from the web (32) in order not to hinder the longitudinal movement of the tongue (12).

The known expansion joints are complex in design and therefore maintenance-intensive. Furthermore, it is possible for the tongue (12) to tip because of the connectors and fastening means selected.

Expansion joints in accordance with the invention as per a first embodiment principle are shown in FIGS. 2 to 11. The same reference numbers are always used in the drawings for identical elements In the expansion joints in accordance with the invention, the stock rail(10) are assigned tongues (34) that have a standard tongue profile, as in conventional switch systems.

These tongues (34) used for the expansion joints are fixed substantially by a non-positive pressure only connection in accordance with the invention, on the one hand to permit secure pressure against the stock rail head (14) and on the other hand to rule out tipping. Supplementary thereto, or in the event of damage, a positive connection can be used beside the non-positive one.

Figure 2:
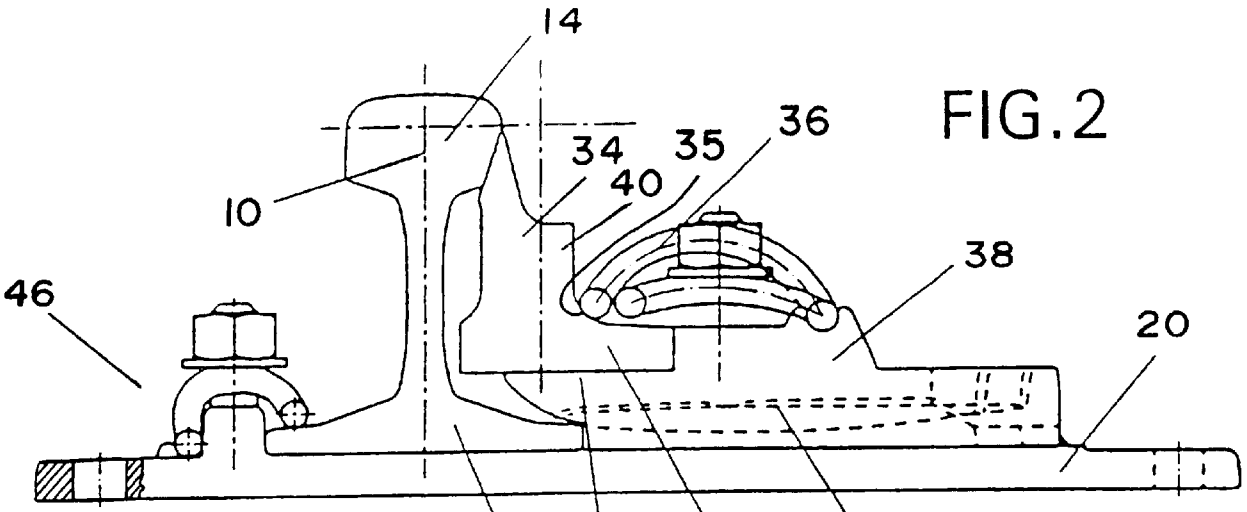
FIG. 2 shows a section through a first embodiment of an expansion joint in accordance with the invention having a tongue comprising a tongue profile.

According to the embodiment in FIG. 2, the non-positive connection is effected by a clamp (36) known per se that extends from a sliding/support block (38) that is preferably permanently connected to the foundation (20), i.e. that can be an integral part thereof.

The clamp (36) then rests in the transitional area between the web (40) and foot (42) of the tongue (34), i.e. in the area (35), as a result of which the transmitted forces is divided into force that run on the ore hand in the direction of the foundation (20) and on the other hand in the direction of the rail head (14).

The tongue (34) is supported in sliding manner on a section (44) of the supporting/sliding block (38), i.e. is above the stock rail foot (16).

The stock rail (10) is tied to a support on the side opposite the tongue (34) by a rib and by a standard clamp (46) or other fastening means used, and held down on the opposite side, i.e. underneath the tongue foot (42), by a spring element (48) extending from the sliding block (38). To that extent, a design is used that is already known from the slide chairs used in switching systems.

Figure 3:
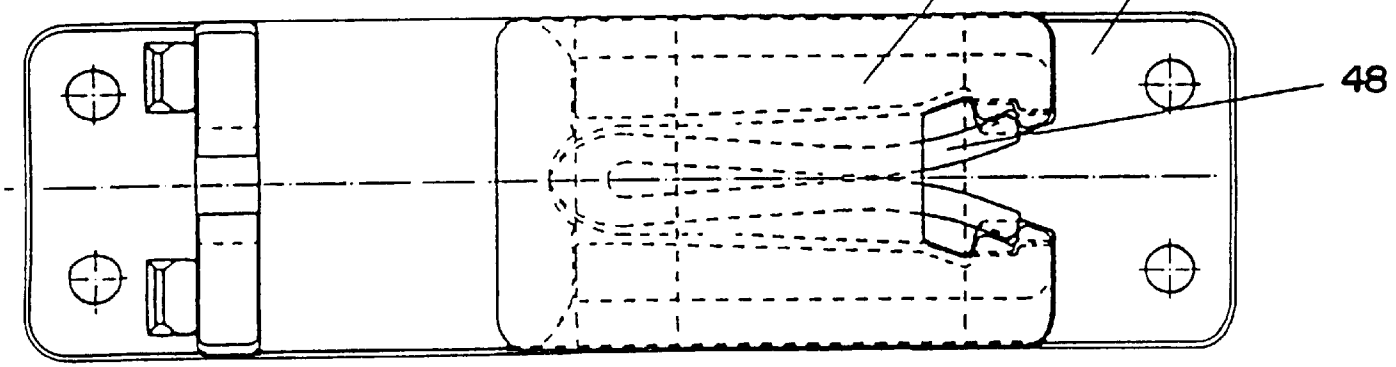
FIG. 3 shows details of a stock rail fastening in the area of the expansion joint in accordance with FIG. 2.
Figure 5:
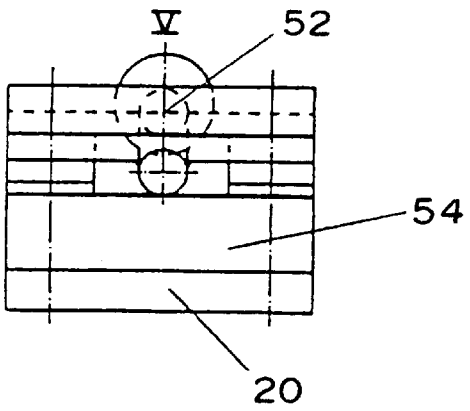
FIG. 5 shows a view in direction V in FIG. 4.
Figure 4:
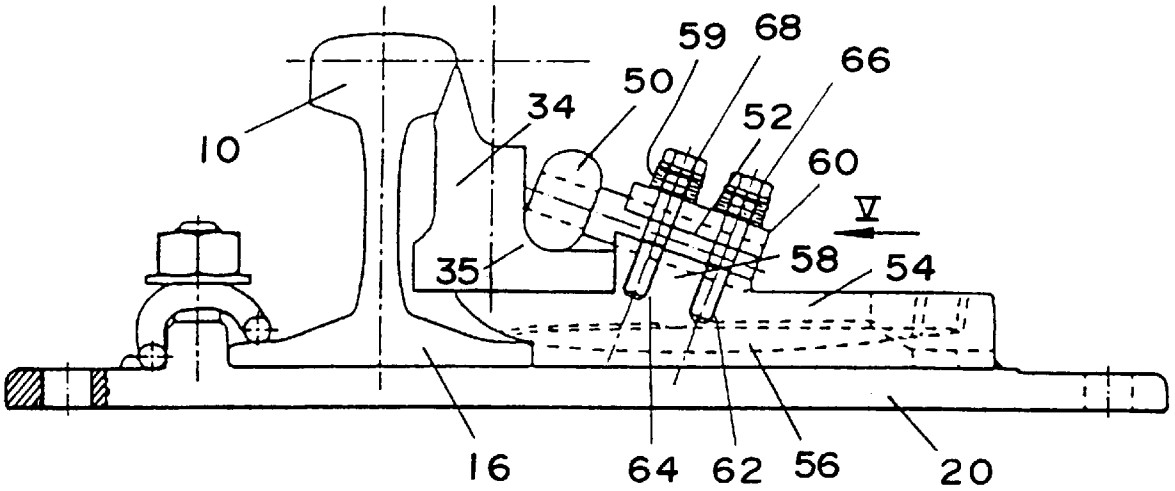
FIG. 4 shows a section through a second embodiment or an expansion joint in accordance with the invention.

The embodiment in FIGS. 4 and 5 differs from that in FIGS. 2 and 3 in that it is not a clamp that is used to fix the tongue (34), but at least one sliding or rolling element (50) supported in the area (35), thereby achieving a reduction in friction during longitudinal movement of the tongue (34).

The sliding or rolling element (50) extends from a shaft (52) fixed on a sliding/supporting block (54) corresponding to that in FIG. 2, i.e. on the one hand firmly connected to the foundation plate and on the other hand fixed by a spring element (56) supported on the stock rail foot (16) for holding down the stock rail (10).

The shaft (52) is clamped between a ramp-like section (58) of the sliding block (54) and an outside plate (60), through which the bolts (62) and (64) pass. Furthermore, plate springs (59), are disposed between the bolt heads and the plate (60).

It is also possible to turn a shaft on a square section or flat material, these latter being bolted to the sliding block, for example. At the same time it should also be made possible for a slight movement to take place in order to compensate for rail tolerances, for example. Here too, plate springs (59) can be used for that purpose.

Figure 7:
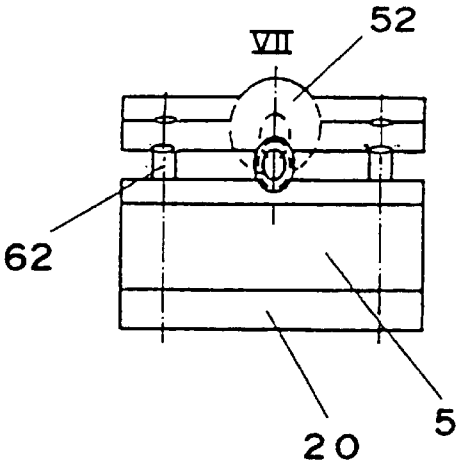
FIG. 7 shows a view in direction VII in FIG. 6.
Figure 6:
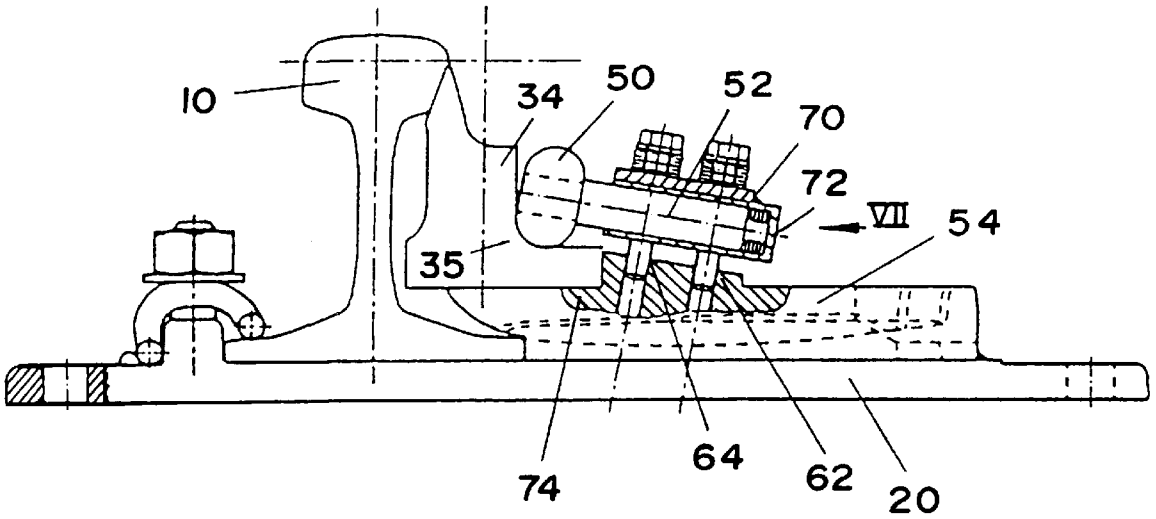
FIG. 6 shows a sectional view through an embodiment of an expansion joint alternative to that in FIG. 4.

The embodiment shown in FIGS. 6 and 7 represents an alternative to that in FIGS. 4 and 5 in that the shaft (52) holding the sliding/rolling element (50) is elastically mounted. For this purpose, the shaft (52) is held by a sleeve (70) in whose longitudinal direction the shaft (52) can be moved such that the sliding element (50) is always pressing against the tongue (34), i.e. is in the area (35). To ensure this, a spring element is provided between the shaft (52) and the bottom (72) of the sleeve (70).

Figure 8:
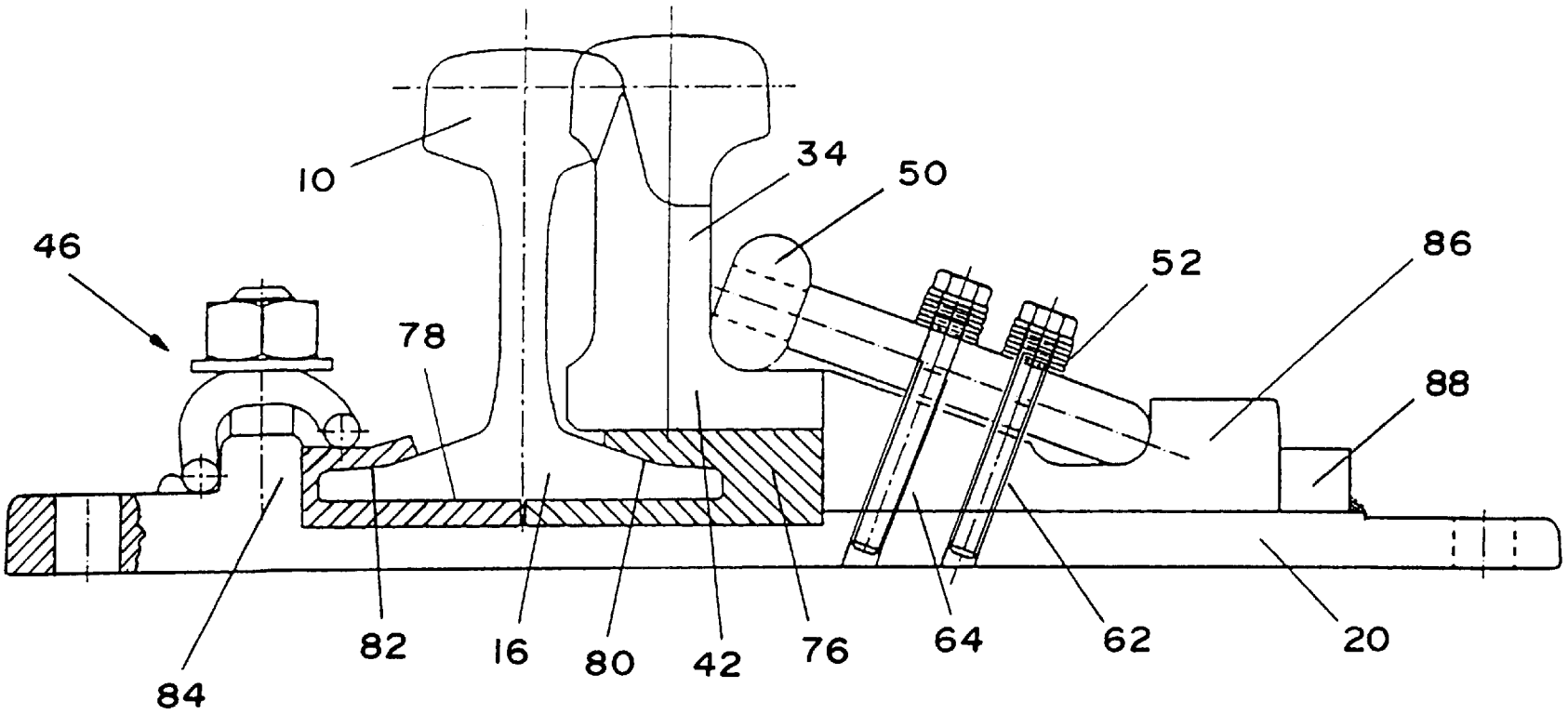
FIG. 8 shows a section through a third embodiment of an expansion joint in accordance with the invention.
Figure 9:
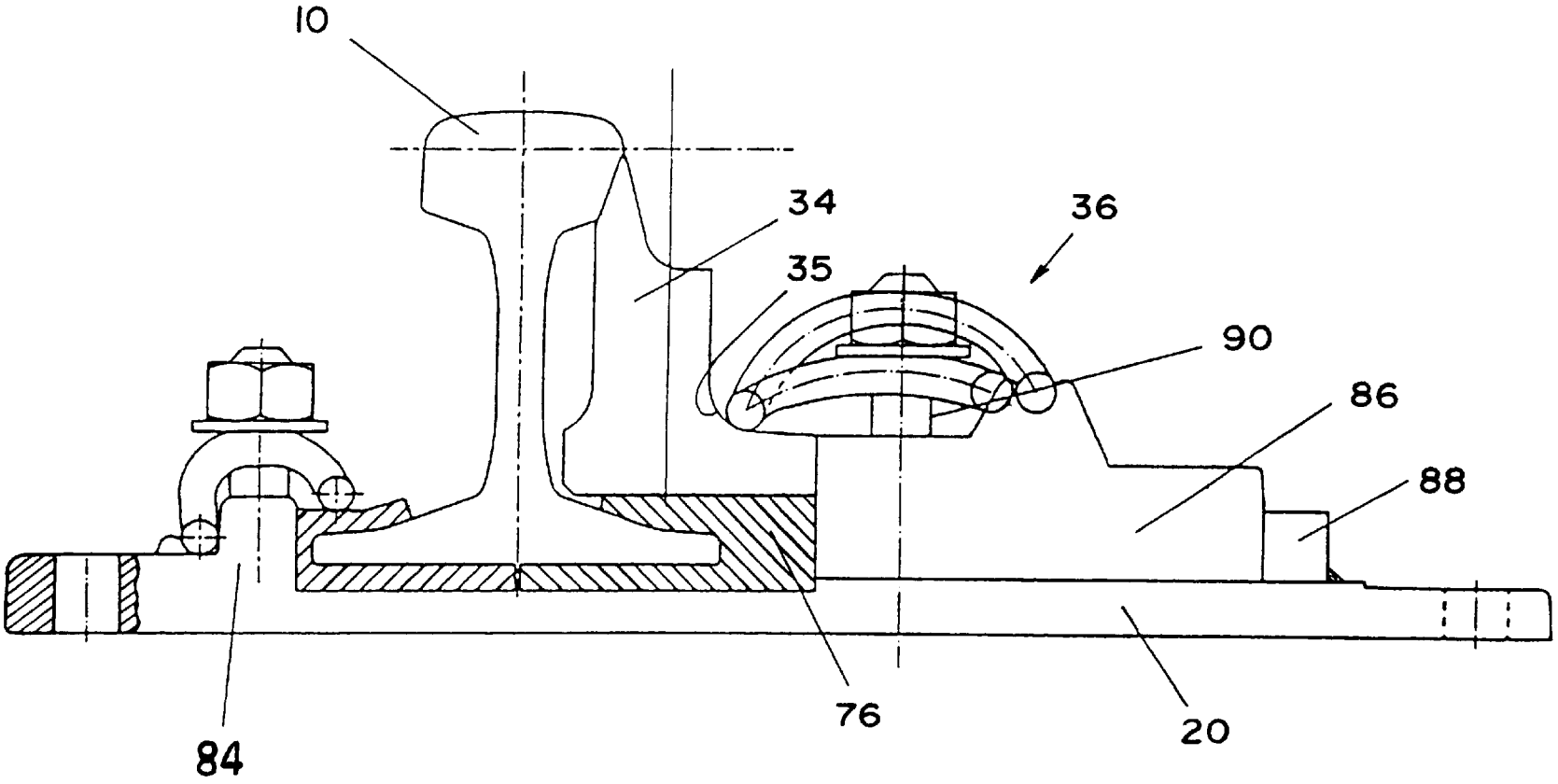
FIG. 9 shows a section through a fourth embodiment of an expansion joint in accordance with the invention.

The embodiments shown in FIGS. 8 and 9 differ from previous ones substantially in the method of fixing the stock rail (10). Accordingly, the non-positive connection between the tongue (34) and the stock rail (10), provided for in accordance with the invention and using, for example, clamps (36) (FIG. 9) or sliding/rolling elements (50) (FIG. 8) or elements having the same effect, remains effective.

Alternatively, the stock rail (10) now no longer has a spring element extending from a supporting/sliding block, but instead a support (76) enclosing the rail foot (16) and supporting the tongue foot (42) in sliding manner.

The support (76), which consist partially or entirely of plastic of a suitable stiffness, accordingly extends along the underside (78) of the stock rail foot (76) and in some areas along the upper side (80) underneath the tongue foot (42), and where necessary also on the opposite upper side (82) in the area of the fastening clamp (46).

The support (76) is limited on the one side by a rib (84) and on the other—the tongue side—by a block (86) preferably made of steel, from which block extends the clamp (36) or shaft (52) of the sliding/rolling element (50).

The block (86) does not necessarily have to be permanently connected to the foundation (20), but can instead be disposed between the support (76) and a stop (88) permanently connected to the foundation (20). In a design of this type, however, anchoring elements such as bolts (62), (64) or (90) (FIG. 9) pass through the block (86) in order to be anchored in the foundation (20) or in a support such as a sleeper underneath the latter. The anchoring elements in turn fix the fastening means that produce the non-positive connection, preferably in the form of the clamp (36) or the sliding/rolling element (50).

Figure 10:
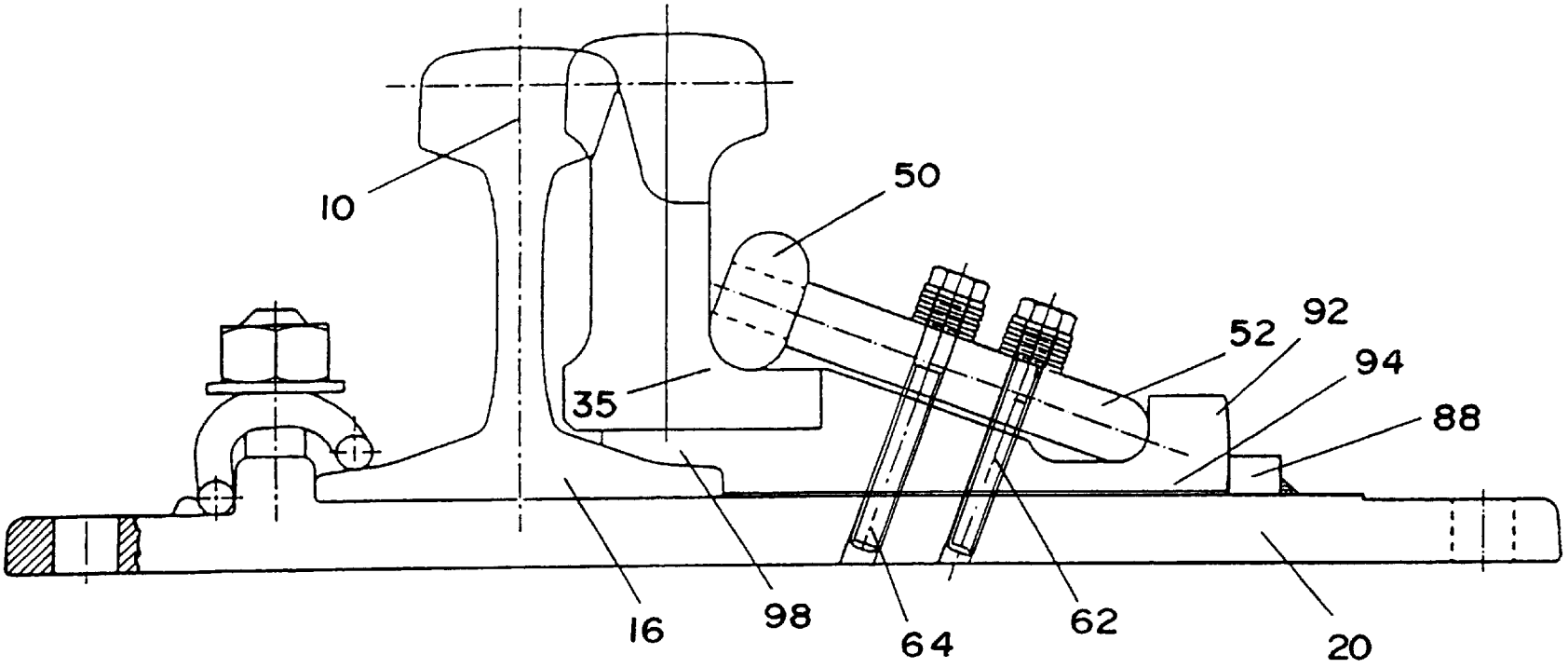
FIG. 10 shows a section through a fifth embodiment of an expansion joint in accordance with the invention.
Figure 11:
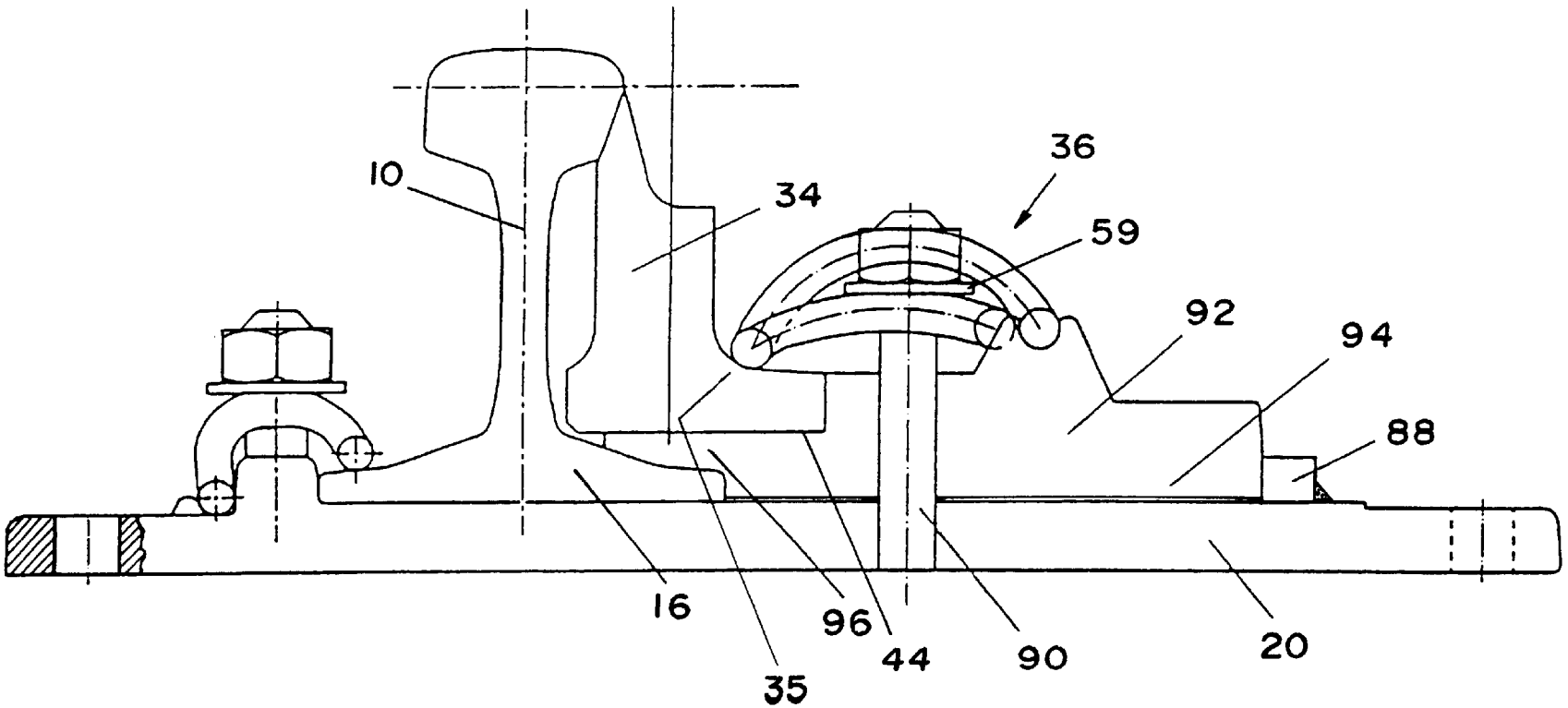
FIG. 11 shows a section through a sixth embodiment of an expansion joint in accordance with the invention.

The embodiments in FIGS. 10 and 11 differ from those in FIGS. 8 and 9 in that the stock rail (10) is held down by a supporting/sliding block (92). The tongue (34) is movable on sliding surface (44). The supporting/sliding block (92) is disposed on the foundation (20) and is fixed using the anchoring elements (62), (64) or (90) of the fastening means (36) or (50),(52).

To ensure tip-free holding down of the stock rail (10), the foundation-side surface (94) of the supporting/sliding block (92) is at a distance from the foundation (20) or there is an elastic layer between them, thereby ensuring that the section (96) of the sliding block (92) extending above the stock rail foot (16) holds down the rail foot (16) to the required extent.

Further noteworthy features of the invention are shown in FIGS. 12 to 20. Since in an expansion joint in accordance with the invention a tongue (34) with a standard tongue profile is used, the latter has a curved section (100) in front of which—i.e. on the tongue tip side—the rail foot underside (102) runs on a higher level than the rail underside (104) in the area facing the tongue root.

Figure 12:
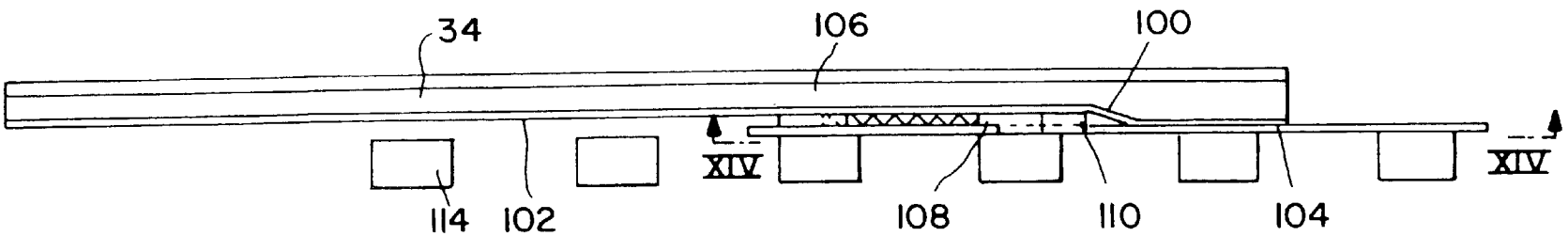
FIG. 12 shows a side view of an expansion joint in the neutral position of a tongue.
Figure 13:
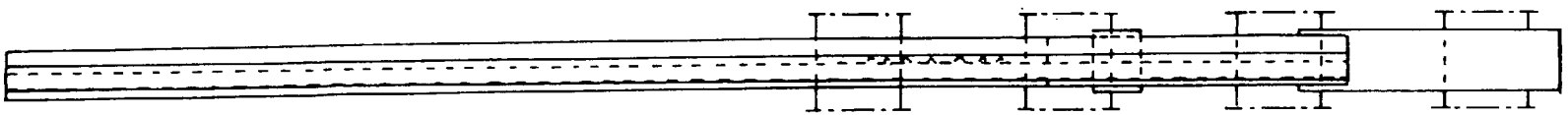
FIG. 13 shows the expansion joint according to FIG. 12 in a plan view.
Figure 14:
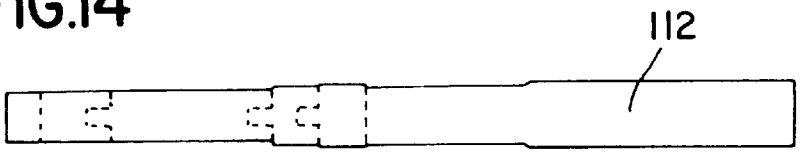
FIG. 14 shows a sliding plate with support blocks disposed on it.

To ensure that the tongue (34) in the front part (106) is supported to the necessary extent even when the tongue (34) is moved in the direction of its tip (+ or moved-in position) or in the direction of its root (– or moved-out position), i.e. is positioned outside the neutral or central position as shown in FIGS. 12 and 14, support blocks (108) and (110) are, in accordance with the invention, movably disposed on a sliding plate (112) that in turn is disposed on supports such as sleepers (114). The movable support blocks (108) and (110) should be movable on the sliding plate (112) in a range that matches the maximum movement of the tongue (34).

Outside the movable support blocks (108) and (110), fixed support blocks are provided in the usual way and can be disposed and fixed on foundations (20) or sleepers (114) in the way explained in the previous embodiments.

The movable support blocks (108) and (110) are spring-loaded against one another and against adjacent fixed support blocks in order to provide the necessary spacing for proper support of the tongue (34). Suitable spring elements are numbered (116) and (118) as examples.

Figure 15:
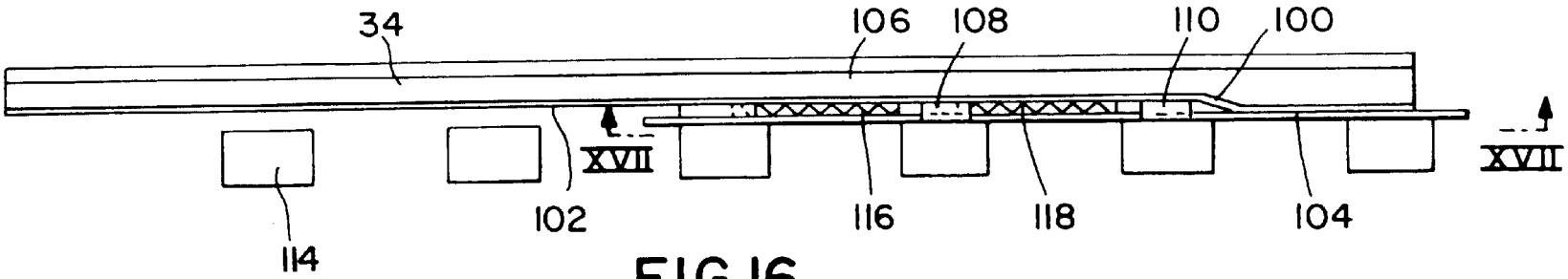
FIG. 15 shows a side view of an expansion joint with retracted tongue.
Figure 16:
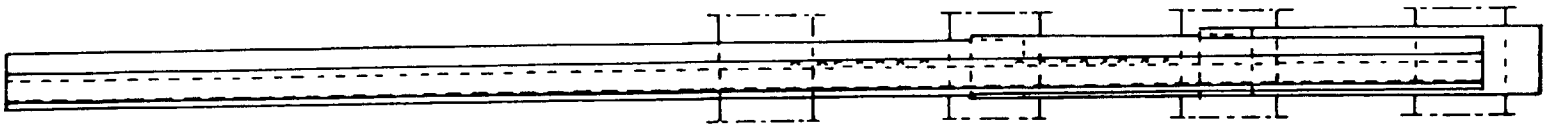
FIG. 16 shows the expansion joint according to FIG. 15 in a plan view.
Figure 17:
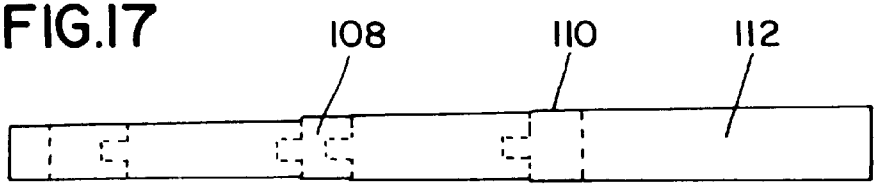
FIG. 17 shows a sliding plate with support blocks as used for the expansion joint according to FIG. 15.
Figure 18:
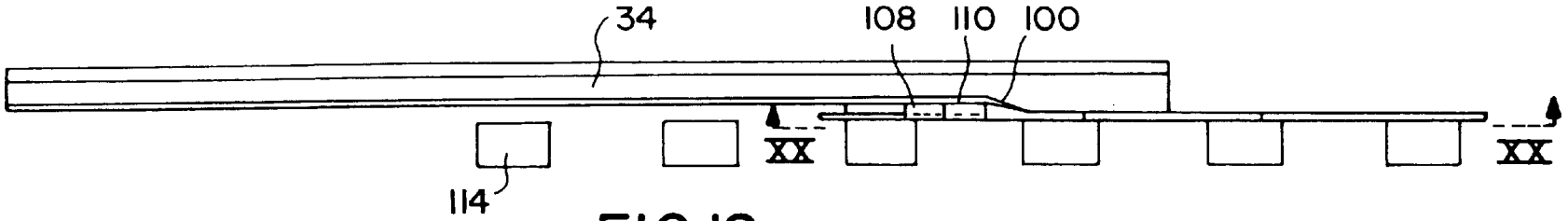
FIG. 18 shows a side view of an expansion joint with advanced tongue.
Figure 19:
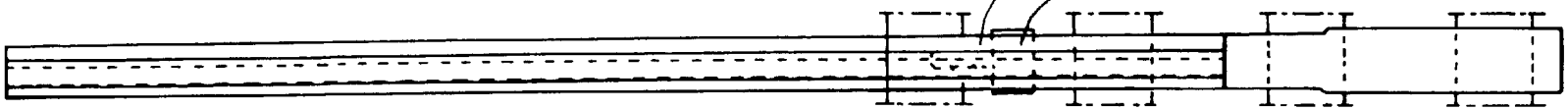
FIG. 19 shows a plan view of the expansion joint according to FIG. 18.
Figure 20:
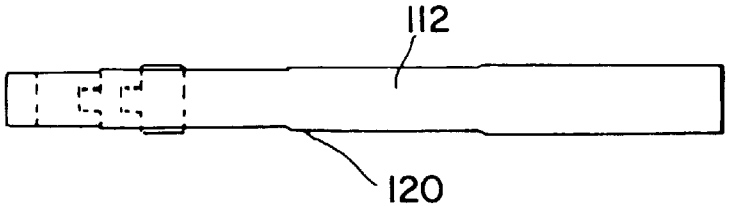
FIG. 20 shows a sliding plate for the expansion joint shown in FIG. 18, with support blocks

As a comparison of FIGS. 15 to 17 (– setting) and 18 to 20 (+ setting) makes clear, the movable support blocks can be moved by the curved section (100) i.e. along the sliding plate (112) in the direction of the tongue tip, when a movement of the tongue (34) itself takes place in this direction. In the case of movement of the tongue (34) in the direction of its root, the movable support blocks (108) and (110) are forced apart by the springs (116) and (118) provided between them. To limit the movement distance here, the sliding plate has catches of the stepped type for the support blocks (108) and (110). A step of this type is numbered (120) as an example.

The movable support blocks (108) and (110), which are disposed as slides on the sliding plate (112) and are movable along the Latter, are now adapted at least in some parts to the geometry of the sliding plate (112) such that the support blocks (108) and (110) can only be moved up to the assigned catches in the direction of the tongue root, as is made clear by FIGS. 15 and 17 in particular.

In other words, the support block (110) can overcome a catch that stops the support block (108). In this way, it is ensured at all times that the tongue (34) is supported to the necessary extent in its transitional area in which the foot undersides are on different levels, where the maximum distance between the support points should equal the spacing of the sleepers (114).

Alternatively, it is also possible to achieve equalisation of the distance using rollers or other suitable means.

Figure 27:
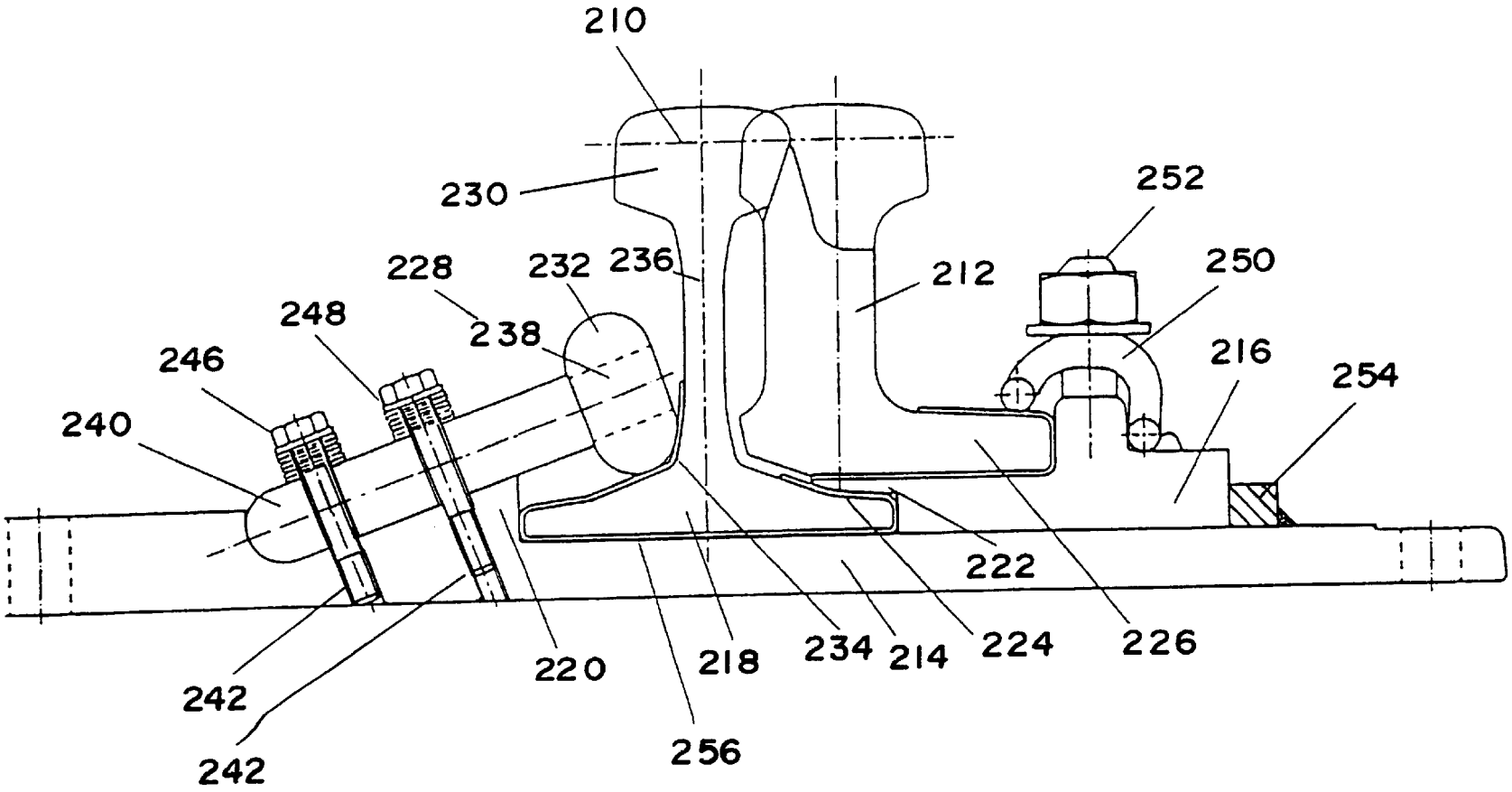
FIG. 27 shows a section through a seventh embodiment of an expansion joint in accordance with the invention.
Figure 28:
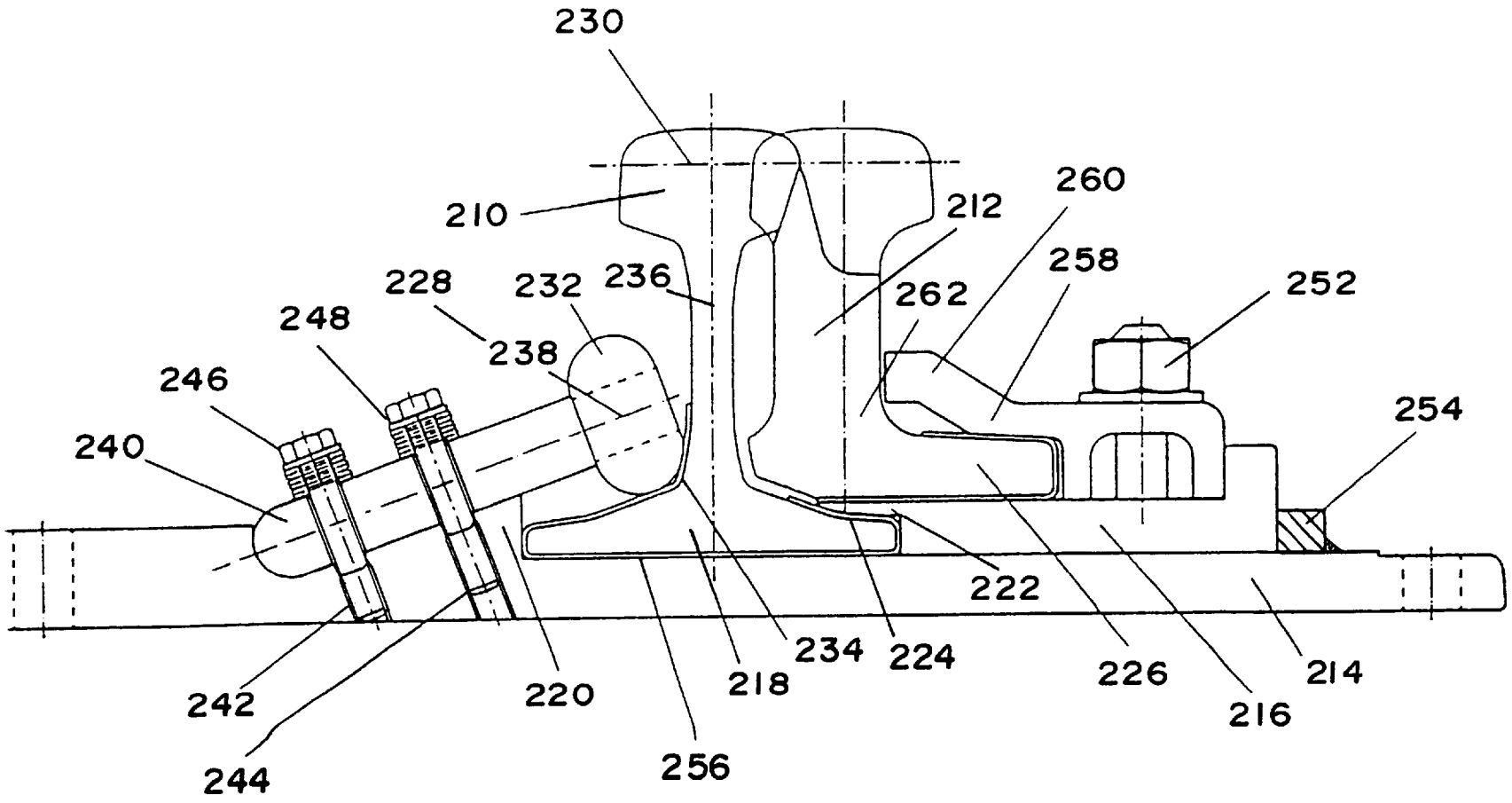
FIG. 28 shows a section through an eighth embodiment of an expansion joint in accordance with the invention.
Figure 29:
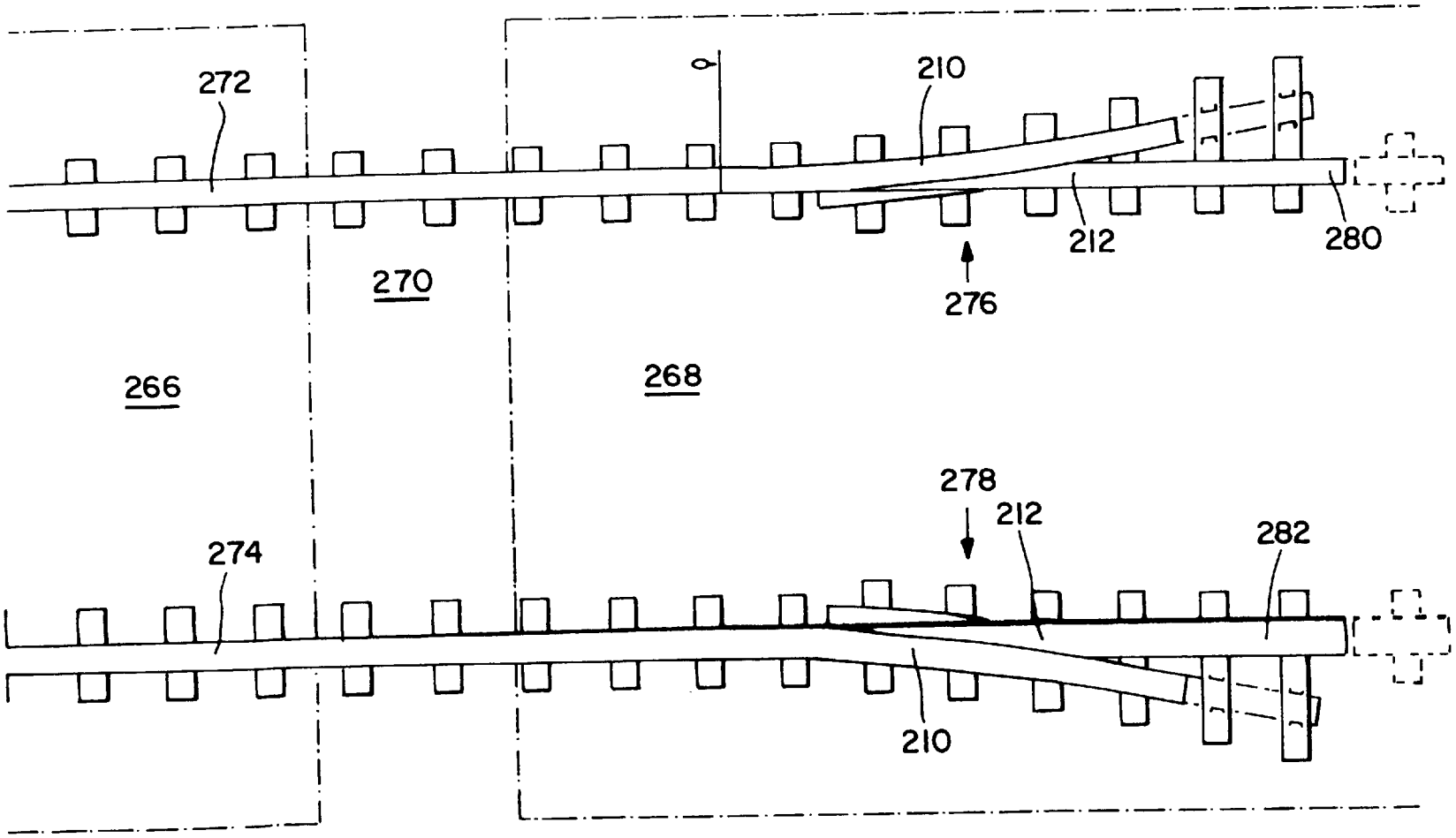
FIG. 29 shows a plan view of a section of track in the area of a structure.

The measures shown in FIGS. 12 to 20 are of course also applicable to expansion joints in which the stock rail is movable in relation to the tongue (FIGS. 27–29).

In order to achieve a slight track widening in the area of an expansion joint, the stock rail shape of the expansion joint is changed in accordance with an independent solution proposal such that it follows the bending line of the tongue which is pressing against the stock rail and is movable relative thereto, as a result of which only small forces have to be transmitted into the tongue to ensure firm pressure. At the same time, this reduces wear, and hence ensures quiet running for rolling stock crossing an expansion joint of this type.

Figure 21:
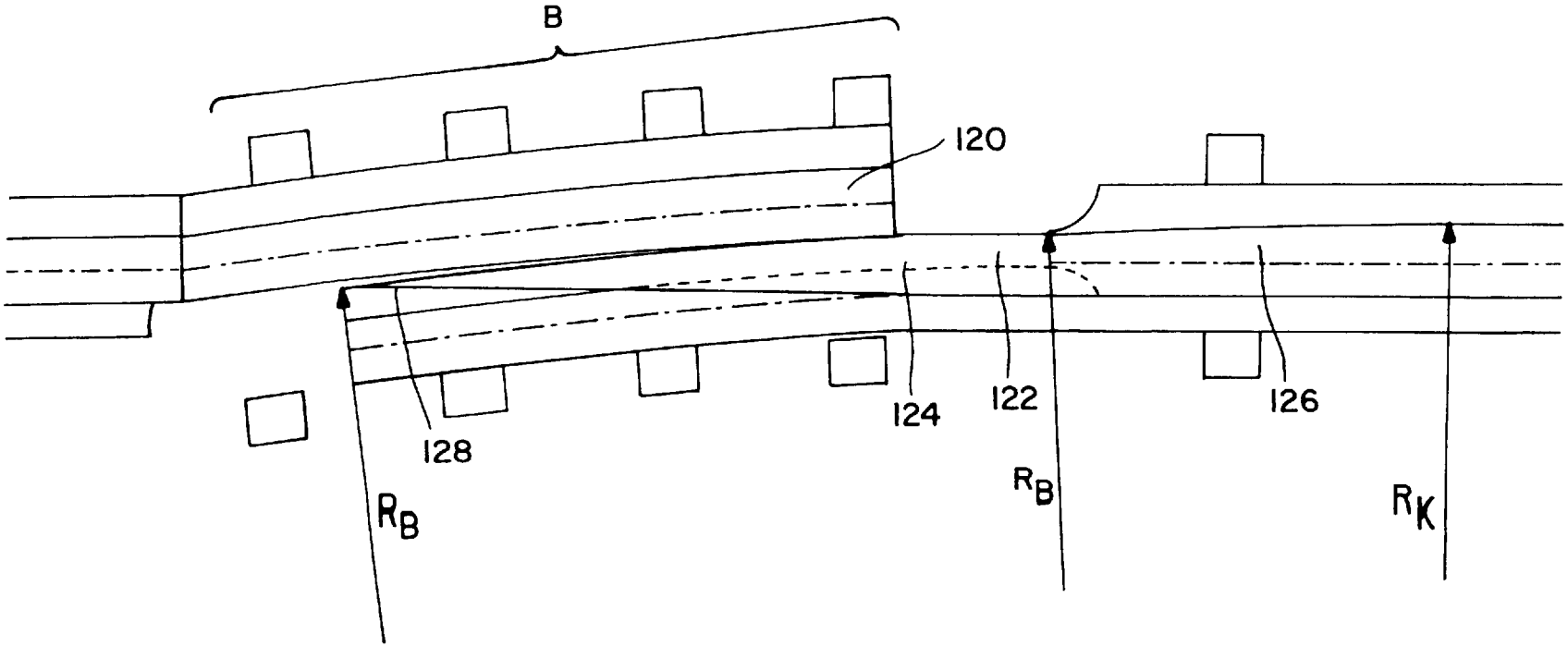
FIG.21 PRIOR ART
FIGS. 21–23 show plan views of expansion joints with a stock rail shape according to the prior art.
Figure 22:
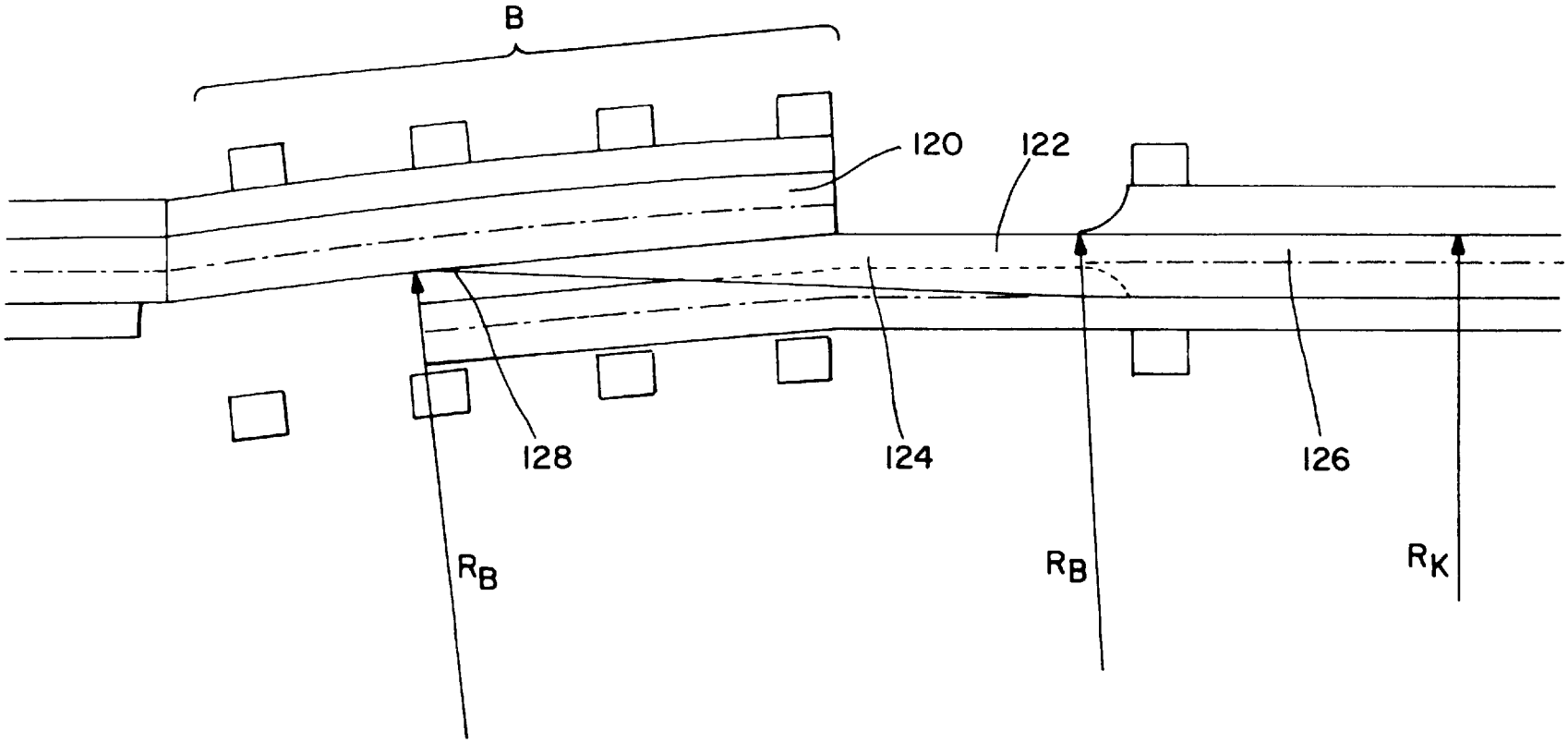
FIG.22 PRIOR ART
Figure 23:
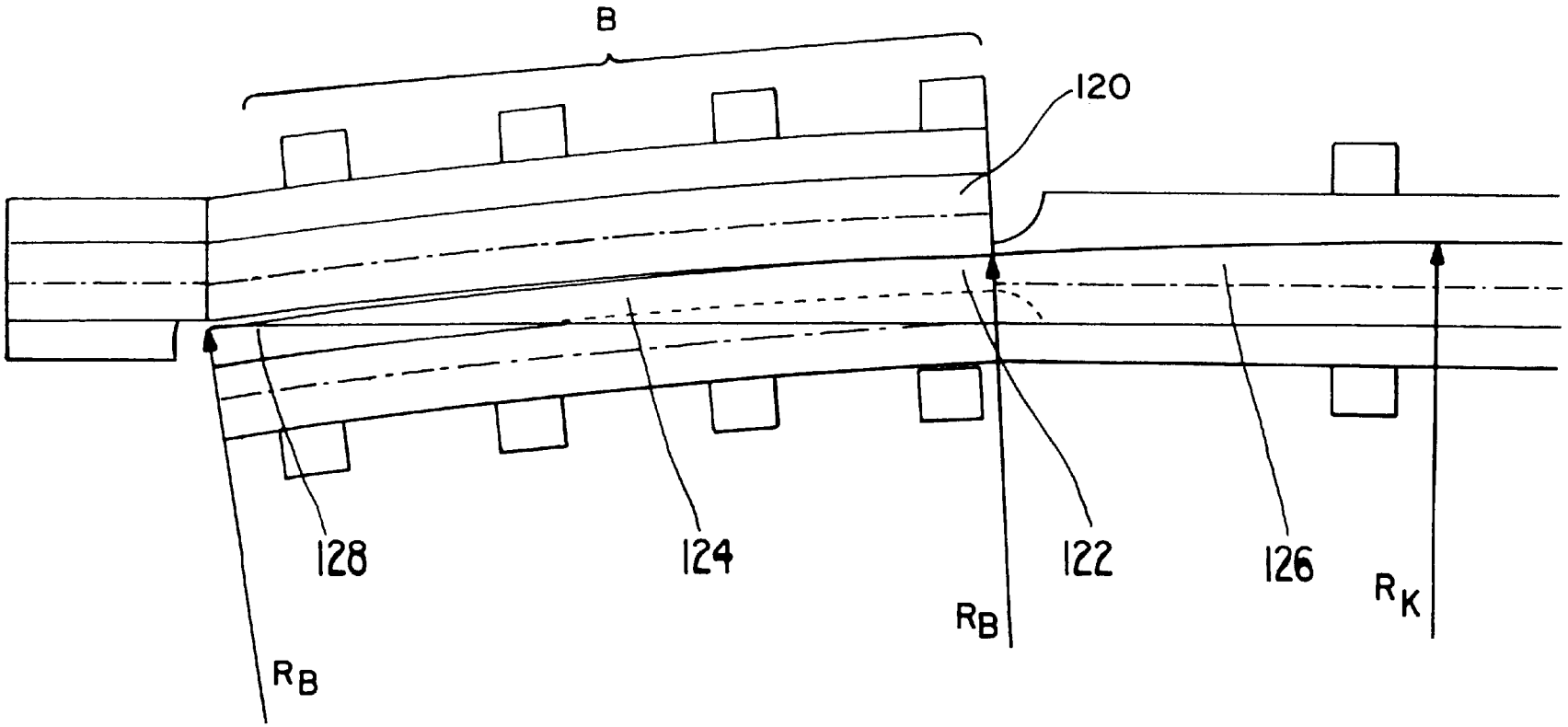
FIG.23 PRIOR ART
Figure 24:
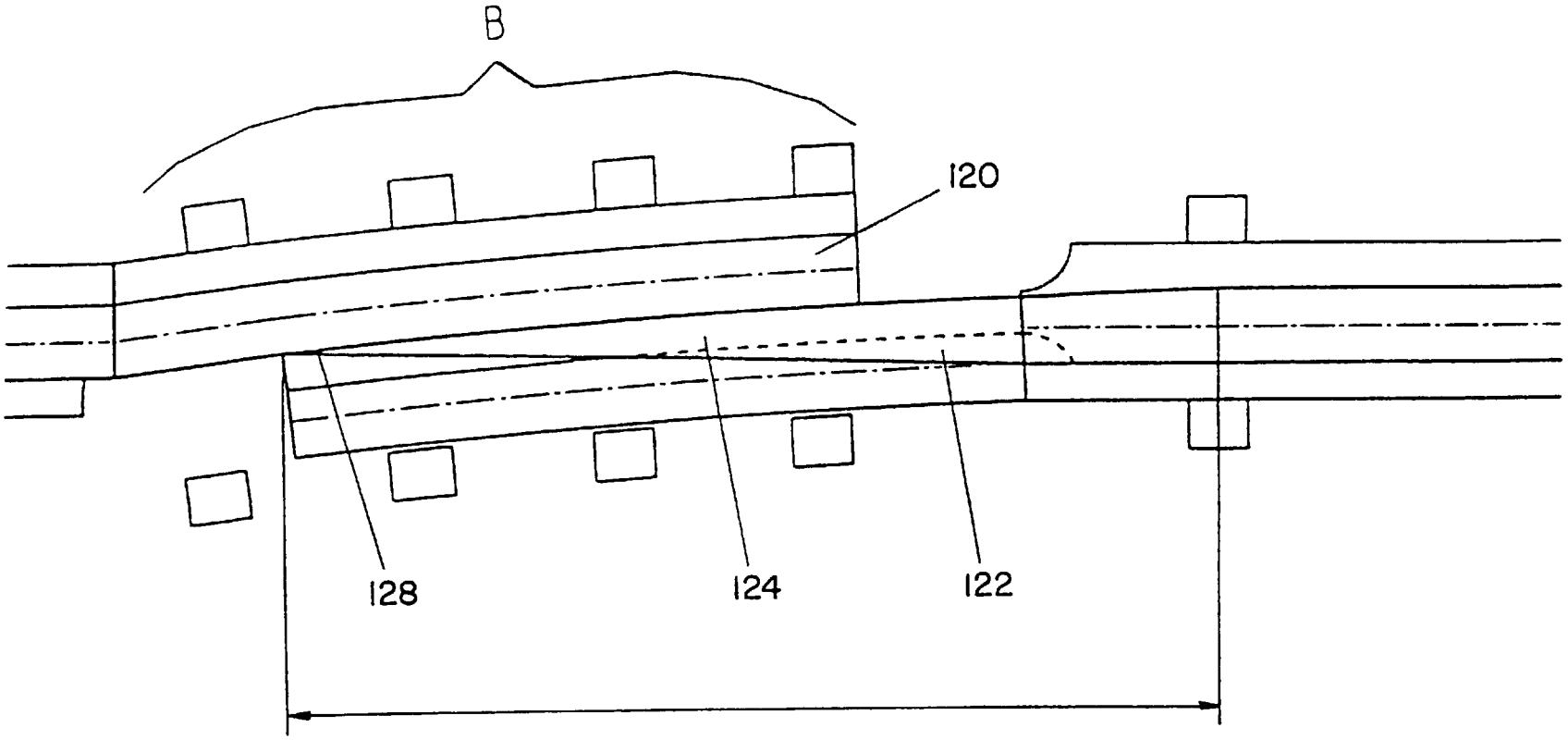
FIGS. 24–26 show plan views of expansion joints with a stock rail having a shape in accordance with the invention.
Figure 25:
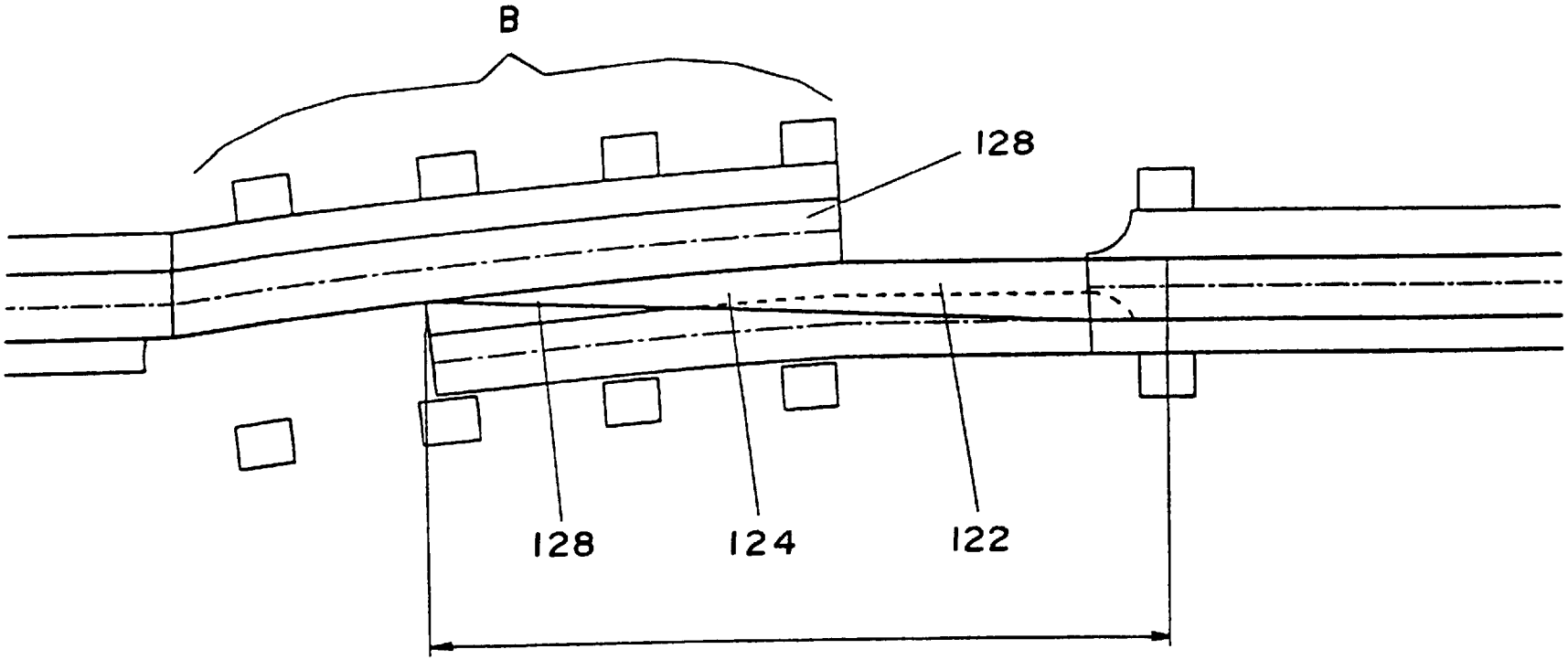
Figure 26:
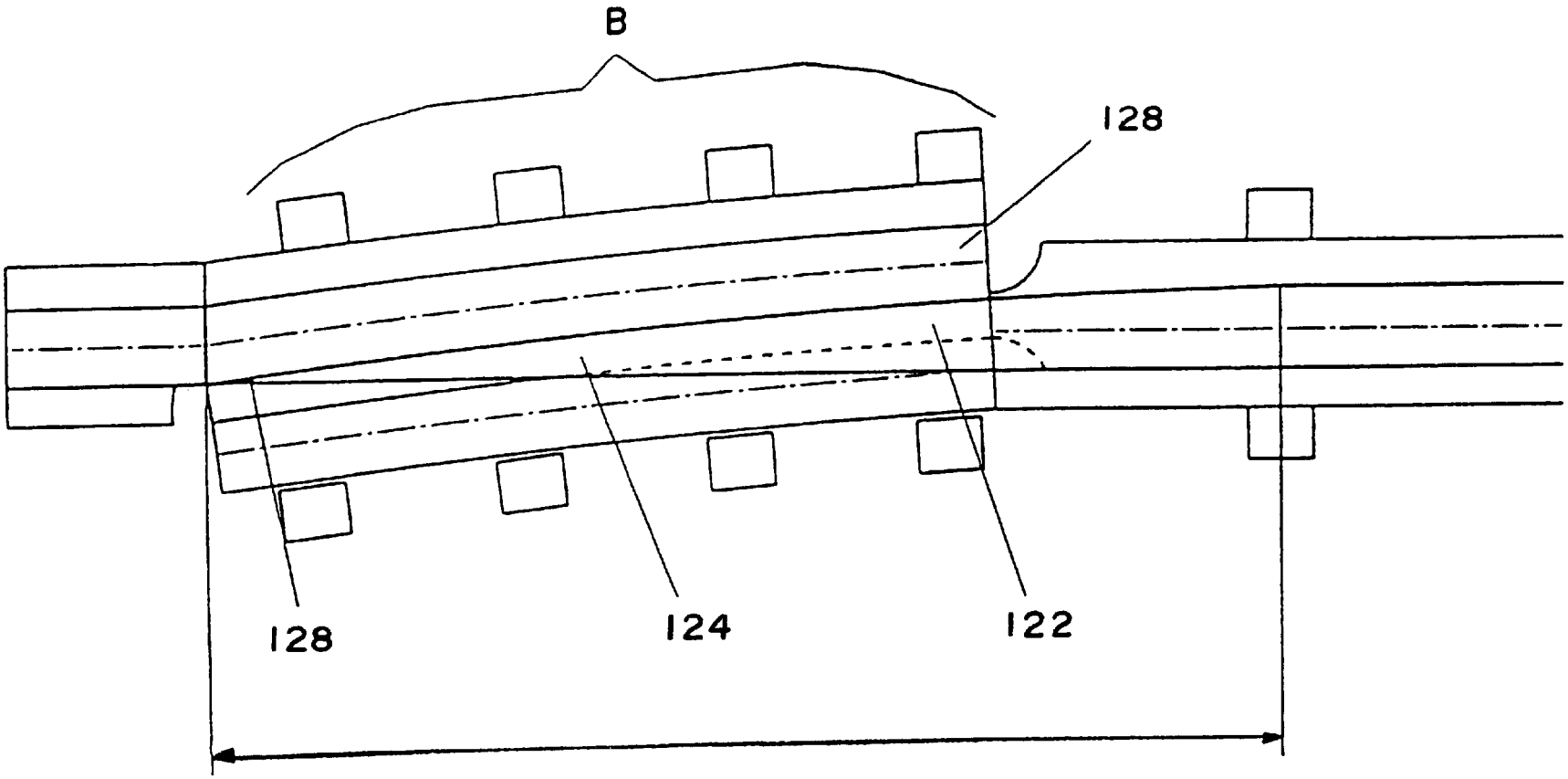

According to the prior art (in FIGS. 21–23), a stock rail (120) has at its front end an area (B) along which a tip of a tongue (123) is movable. The area (B) has, according to the prior art, a curvature with a radius ($R_B$), and hence follows a circle.

The section (124) of the tongue (122) movable along the stock rail (120) is fixed at a distance from the stock rail (120) such that movement is exclusively in the longitudinal direction of the tongue (122). In this area (numbered 126), the tongue has a curvature which—as implied for the sake of simplicity—follows a circle with the radius ($R_K$).

This takes into consideration the curvatures of the sides facing one another both of the stock rail (120) and of the tongue (122).

Since the section (124) is—as already mentioned—to be considered as a projecting bar element clamped on one side, the section (124) undergoes—when a transverse force caused by interaction with the stock rail (120) is transmitted—a bending process that does not follow the curvature radius ($R_B$) but a different course instead. Due to the curvature of the stock rail (120), i.e. its tongue-side head flank, a persistent bending of the section (124) heavier than that of the natural bending line takes place. As a result, the tip (128) of the tongue (122) increasingly moves away from the stock rail, as the differing positions of the tongue (122) in FIGS. 21, 22 and 23 make clear. An undesirable track widening takes place as a result. In order to force the tip (128) into contact with the stock rail, considerable forces are therefore necessary.

In an expansion joint in accordance with the invention, in which the tongue does not necessarily have to be in non-positive contact with the stock rail, a stock rail (128) follows in its area (B) a curved path corresponding to the bending line of the section (124) of the tongue (122). As a result, the section (124) is always pressing against the stock rail (128) to the required extent. Accordingly, no inadmissible track widening can take place.

Plastic intermediate layers or inserts can—when used—be secured against movement relative to the fastening parts by structuring the edge area with beads, pimples or other suitable shape changes.

FIGS. 27 to 29 show a further embodiment of the invention that enjoys independent protection.

FIG. 29 shows in purely diagrammatic form a plan view of a section of railway track in the vicinity of a structure (266) such as a bridge.

The rail section extends from the structure (266) to firm ground (268), with an expansion device (270) being provided between the firm ground (268) and the structure (266).

In order to compensate for changes in the distance between the structure (266) and the firm ground (268), or changes in the length of the track, i.e. of the rails (272) and (274), expansion joints (276) and (278) are provided that are disposed on the firm ground (268) in this embodiment. It is of course quite possible to provide suitable expansion joints on the structure (266).

The expansion joints (276) and (278) comprise in each case a stock rail (210) and a pointed tongue (212) assigned to it. Here the stock rail (210) is—unlike in the prior art—movable along the points tongue (212).

Otherwise, the rails (272) and (274) and the control rails (280) and (282) extending from the pointed tongues (212) are connected in known manner to the respective base, for example by foundation plates and for example by sleepers.

In order to transmit low transverse forces during the longitudinal movement of the stock rails (210) so that the latter are moved along the pointed tongues (212) without a resultant track change in the area of the expansion joints (276) and (278), it is provided that the areas of the pointed tongues (212) against which the stock rails (210) press have a curvature radius corresponding to the bending lines ρ of the stock rails (210).

The bending line ρ here corresponds to the curvature described by a stock rail clamped on one side when transverse forces are being transmitted.

In other words, the curvature ρ of that area of the points tongue (212) against which the stock rail (210) presses during its longitudinal movement corresponds to the natural curvature or bending line of the stock rail, when viewed as a bar element clamped on one side and on the projecting area of which transverse forces act.

This curvature ensures that the stock rail (210) is always pressing against the pointed tongue (212), so that inadmissible track widening is ruled out.

The expansion joint (276) or (278) in accordance with the invention is described in detail in FIGS. 27 and 28. The same elements have the she reference numbers in these figures. FIGS. 27 and 28 show a section along the line A—A through the expansion joint (278) comprising the stock rail (210) and the tongue (212) pressing against it.

The tongue (212) is preferably one with a conventional, pointed tongue profile as in switching systems.

Unlike in known expansion joints, the stock rail (210) is movable in its longitudinal direction in relation to the tongue (212).

The stock rail (210) is disposed on a foundation (214). The stock rail (210) is supported with its foot (218) between a rib (22C) and a section (222) of a support block (216) on which the tongue (212) is supported.

The support block (216) partially covers the section (222) of the upper side of the stock rail (218), thereby ensuring that the stock rail (210) cannot tip over. To ensure secure holding down by the section (222), an intermediate layer (224) can be provided between the section (222) and the rail foot (218), and can also extend underneath the stock rail foot (218) and the foot (226) of the tongue (212).

It is also possible to dispose the support block (216) on an elastic intermediate layer, such that when force is transmitted to the support block (216) in the direction of the foundation (214) the section (222) is resting on the stock rail foot (218).

On the side facing away from the tongue (212), a fastening means (228) acts on the stock rail (210), through which means force components are transmitted in the direction both of the foundation (214) and of the rail head (240), in the contact area between the tongue (212) and the stock rail (210). The result is a non-positive connection that ensures firm pressing of the tongue against the stock rail head (230).

To break up the force components, the fastening means (228) is supported by a rolling or sliding element (232) or element having the same effect on the transitional area (234) between the stock rain foot (218) and the web (236).

The rolling or sliding element (232) extends from a shaft (238) which is—for example—machined on a flat or square iron section (240) that is connected by anchoring means such as bolts (242) and (244) to the foundation (214). Plate springs (246) and (248) are provided between the bolt heads—not described in detail—and the flat or square iron section (240), in order to permit flexible support, thanks to which rail tolerances in particular can be compensated for.

Other non-positive connections between the foundation (214) and the stock rail (210) are also possible. One type of connection is described in DE 40 14 325 A1, for example.

The tongue (212) is fixed in the embodiment according to FIG. 27 by a clamp (250) secured by a connecting element such as a bolt, with the support block (216) in its turn connected to the foundation (214). Of course it can also be welded. On the outside, the support block (216) contacts a stop (254) extending from the foundation (214).

To ensure that the stock rail (210) is longitudinally movable in relation to the tongue (212), i.e. that the stock rail (210) is supported in a more sliding manner than the tongue (212), an intermediate layer (256) extends underneath the support surfaces of the stock rail foot (218) and the tongue foot (226) and has in the area of the stock rail foot (218) other material properties than underneath the tongue foot (226) such that in the area of the support surface of the stock rail foot (218) a friction coefficient of $\mu_B \geqq 0.1$ is obtained and in the supporting surface of the tongue foot (226) a friction coefficient $\mu_Z \leqq 0.3$.

The intermediate layer (256) can extend on the one side into the area of the foot-side support of the clamp (250) and on the other side into the transitional area (234) between the stock rail foot (218) and web (236) in which the rolling or sliding element (232) is supported.

The intermediate layer can of course also be replaced by other suitable measures; for example it is possible to deposit or spray materials onto the stock rail foot or onto the slide chair, for example, in order to obtain the required friction coefficients.

The embodiment in FIG. 28 differs from that in FIG. 27 to the extent that the tongue (212) is fixed not by a clamp, but by a clamping plate (258) from which extends a support (260) pressing against the web (262) of the tongue (212).

In the embodiment according to FIG. 28, the intermediate layer (256) extends as far as the area of the support of the clamping plate (258) on the tongue foot (226).

It is of course not necessary for the intermediate layer (256) to be continuous; several intermediate layers can be used, each of which only extends underneath the stock rail foot (218) or tongue foot (226) and if necessary into the area of the support for the fastening elements, i.e. the clamping plate (258) or the sliding/rolling element (232).

Concerning the intermediate layer, it must also be noted that this can be structured in some sections in order to prevent any movement in the direction of the track axis relative to the surrounding elements. Structuring is possible by, for example, a catch, chamfer, bead or similar device.

It must also be pointed out that fastening means (clamp, clamping plate) fixing the tongue can be disposed in a regular or irregular sequence.

What is claimed is:

1. An expansion joint for part of a railway track disposed on a foundation comprising: a first fixed rail section; a second rail section movable in relation to said first fixed rail section, said second rail section being pressed against said first rail section over a predetermined contact area; said first fixed rail section having in said predetermined contact area in which said movable second rail section is pressed into contact, a curvature corresponding to the bending line of said movable second rail section; said first rail section has a switch tongue shape and said second rail section is a stock rail.

2. An expansion joint for part of a railway track capable to compensate for changes in length disposed on a foundation comprising:

a first rail section having a contact area of predetermined length, said first rail section being clamped to the foundation; a second rail section movable in relation to the first rail section; means for fastening said second rail section to be pressed against said first rail section over the predetermined contact area; said means for fastening causing bending of the second rail section; said first rail section having in said predetermined contact area in which said movable second rail section is pressed into contact, a curvature corresponding to the bending line of said movable second rail section;

the means for fastening the second rail section to be pressed against the first rail section includes a shaft extending over a foundation, a rolling element at the end of said shaft; and a spring element for holding down the first rail section.

3. An expansion joint according to claim 2, wherein said first rail section is formed to have a switch tongue shape and said second rail section is a stock rail.

4. An expansion joint according to claim 3, wherein fastening means acts on said stock rail and effects a non-positive connection between said stock rail head and said tongue, where said fastening means is spring-loaded and extending directly from said foundation and is supported in the transitional area of said stock rail foot and said web.

5. An expansion joint according to claim 2 wherein said first rail section is a stock rail and said second rail section is formed to have a switch tongue shape.

6. An expansion joint according to claim 5, wherein said second rail section is disposed in a longitudinally movable manner.

7. An expansion joint according to claim 5, wherein said second rail section is supported on a sliding block on the foundation that, on the one hand, rests on a stock rail foot and, on the other hand, presses against a stop means on the side facing away from the stock rail, and wherein said sliding block is disposed movably in relation to the foundation and is passed through by an anchoring means, connecting said means for fastening to the foundation, said anchoring means being supported in relation to said means for fastening by plate springs.

8. An expansion joint according to claim 5, wherein said second rail section is supported in a tongue tip area, on movable support blocks that, on the one hand, follow the longitudinal movement of said second rail section and, on the other hand, on support blocks that are fixable at predetermined points.

9. An expansion joint according to claim 8, wherein said stock rail is supported on the one hand, on movable support blocks that follow the longitudinal movement of said stock rail and, on the other hand, on support blocks that are fixable at predetermined points.

10. An expansion joint according to claim 9, wherein said movable support blocks are arranged to move on a sliding plate, to limit the movement distance, said sliding plate has catches for said movable support blocks in the area of sleepers.

11. An expansion joint according to claim 10, wherein said movable support blocks are spring-loaded against one another and in relation to at least one of the fixed support blocks to provide spacing for proper support of the tongue.

12. An expansion joint according to claim 2 wherein said first rail section is a stock rail having a head, a web and a foot, said second rail section is formed to have a switch tongue shape having a foot portion, a head portion and a web in the transitional section between said foot portion and said head portion.

13. An expansion joint according to claim 12, including a support enclosing at least partly the foot potion of said first rail section, said support slidingly supporting the second rail section foot portion.

14. An expansion joint according to claim 13, wherein said support enclosing the foot portion of said first rail section consists of a plastic material.

15. An expansion joint according to claim 2 wherein said first rail section is a stock rail having a head, a web and a foot, said spring element holding down the foot of said first rail section.

16. An expansion device according to claim 15, wherein a friction coefficient of $\mu_B \geqq 0.1$ exists between an underside of said second rail section foot and the foundation, and a friction coefficient of $\mu_Z \geqq 0.3$ between the sliding surface of the block and a contacting surface.

17. An expansion joint for part of a railway track disposed on foundation means including a foundation and a support block disposed thereon, said expansion joint comprising:

a first substantially fixed rail section having a predetermined contact area, a second rail section movable in relation to the first rail section, fastening means for pressing said second rail section against said first rail section over said predetermined contact area, said fastening means causing bending of the second rail section;

said first rail section having in said predetermined contact area in which said movable second rail section is pressed into contact, a curvature corresponding to the bending of said movable second rail section;

said first rail section is a stock rail having a head and said second rail section has a switch tongue shape;

said foundation means including a foundation and a support block disposed thereon;

said fastening means extending from said foundation means support block, and being supported by a sliding element for applying pressure in a transitional area which is formed between a foot and a web of the switch tongue in order to transmit force components in the direction of said foundation means and in the direction of said stock rail head;

said sliding element extending from a shaft, said shaft being movable in relation to said foundation means.

18. An expansion joint according to claim 17, wherein said fastening means extending from the foundation means support block, includes a rolling element in the transitional area which is formed between tongue foot and tongue web in order to transmit force components in the direction of said foundation means and in the direction of said stock rail head, said rolling element extending from an element having a shaft, said element being movable in relation to said foundation means.

19. An expansion joint for part of a railway track capable to compensate for changes in length disposed on a foundation means comprising:

a first rail section having a contact area of predetermined length, said first rail section being clamped to the foundation means; a second-rail section movable in relation to the first rail section; means for fastening said second rail section to be pressed against said first rail section over the predetermined contact area; said means for fastening causing bending of the second rail section; said first rail section having in said predetermined contact area in which said movable second rail section is pressed into contact, a curvature corresponding to the bending line of said movable second rail section;

said first rail section is a stock rail having a head and said second rail section has a switch tongue shape, the foundation means including a foundation and a sliding support block disposed therein;

said means for fastening extends from said foundation means sliding support block, and is supported by a rolling element in the transitional area which is formed between tongue foot and tongue web in order to transmit force components in the direction of said foundation means and in the direction of said stock rail head, said rolling element extending from a support element having a shaft, said support element being movable in relation to said-foundation means.

20. An expansion joint for part of a railway track capable to compensate for changes in length disposed on a foundation means comprising:

a first rail section having a contact area of predetermined length, said first rail section being clamped to the foundation means; a second rail section movable in relation to the first rail section; means for fastening said second rail section to be pressed against said first rail section over the predetermined contact area; said means for fastening causing bending of the,second rail section; said first rail section having in said predetermined contact area in which said movable second rail section is pressed into contact, a curvature corresponding to the bending line of said movable second rail section;

said second rail section is a stock rail having a head and said first rail section has a switch tongue shape, the foundation means including a foundation and a sliding support block arranged therein;

said means for fastening extends from said foundation means sliding support block, and is supported by a rolling element in the transitional area which is formed between stock rail foot and stock rail web in order to transmit force components in the direction of said foundation means and in the direction of said stock rail head, said rolling element extending from a support element having a shaft, said support element being movable in relation to said foundation means.

* * * * *